US008262087B2

(12) United States Patent
Foerch et al.

(10) Patent No.: US 8,262,087 B2
(45) Date of Patent: Sep. 11, 2012

(54) DEVICE FOR FEEDING SHEETS TO A SHEET STACK WITH AT LEAST TWO CLUTCHES DISPOSED AT A DISTANCE IN A SHEET TRANSPORT DIRECTION

(75) Inventors: Peter Foerch, Neustadt (DE); Georg Grasmueck, Deidesheim (DE); Markus Moehringer, Weinheim (DE); Stefan Mutschall, Oestringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/052,406

(22) Filed: Mar. 21, 2011

(65) Prior Publication Data

US 2011/0227280 A1 Sep. 22, 2011

(30) Foreign Application Priority Data

Mar. 19, 2010 (DE) ..... 10 2010 012 104

(51) Int. Cl.
*B65H 29/04* (2006.01)

(52) U.S. Cl. ..... 271/264; 198/468.3; 101/232; 101/408

(58) Field of Classification Search ..... 271/264, 271/204, 206; 198/468.3, 473.1; 101/232, 101/407.1, 408; *B65H 29/04*
See application file for complete search history.

(56) References Cited

U.S. PATENT DOCUMENTS

| | | | | |
|---|---|---|---|---|
| 5,150,652 | A * | 9/1992 | Yamamoto et al. | 101/232 |
| 5,771,058 | A * | 6/1998 | Kobayashi | 271/186 |
| 7,261,291 | B2 | 8/2007 | Foerch et al. | |
| 7,367,558 | B2 | 5/2008 | Föech et al. | |
| 7,484,610 | B2 | 2/2009 | Friedrichs et al. | |
| 2010/0064916 | A1 | 3/2010 | Noell | |

FOREIGN PATENT DOCUMENTS

| | | | |
|---|---|---|---|
| DE | 10343428 | A1 | 5/2004 |
| DE | 102007050378 | A1 * | 5/2008 |
| DE | 102007061394 | A1 * | 6/2009 |
| JP | 61174058 | A * | 8/1986 |
| JP | 05097273 | A * | 4/1993 |

OTHER PUBLICATIONS

German Search Report dated Nov. 22, 2010.

* cited by examiner

*Primary Examiner* — Gerald McClain
(74) *Attorney, Agent, or Firm* — Laurence A. Greenberg; Werner H. Stemer; Ralph E. Locher

(57) ABSTRACT

In a delivery of a sheet-processing machine, in particular a printing press, provision is made for chain gripper systems for holding the sheets to be transported at the leading and trailing edges thereof. The holding devices are configured such that they can be displaced relative to one another for the purpose of format adjustment. The chain gripper system has a sprocket drive shaft and a sprocket deflection shaft for the chains of the chain gripper system. Here, provision is made for both the sprocket drive shaft and the sprocket deflection shaft to have a clutch.

11 Claims, 4 Drawing Sheets

DEVICE FOR FEEDING SHEETS TO A SHEET STACK WITH AT LEAST TWO CLUTCHES DISPOSED AT A DISTANCE IN A SHEET TRANSPORT DIRECTION

CROSS-REFERENCE TO RELATED APPLICATION

This application claims the priority, under 35 U.S.C. §119, of German application DE 10 2010 012 104.5, filed Mar. 19, 2010; the prior application is herewith incorporated by reference in its entirety.

BACKGROUND OF THE INVENTION

Field of the Invention

The invention relates to a delivery of a sheet-processing machine, in particular a printing press, having a chain gripper system for holding and transporting the sheets in each case at the leading and trailing edge thereof.

A chain gripper system of this type is known from published, non-prosecuted German patent application DE 103 43 428 A1, corresponding to U.S. Pat. No. 7,261,129. The chain gripper system has a first driven sprocket shaft and a second sprocket shaft provided to deflect the chains. Here, provision is made for the sprockets to be mounted such that they can be rotated relative to one another for the purpose of format adjustment and that they can be fixed by a rotary clutch.

The chains on which the gripper bars for holding the leading and trailing edges of the sheets to be transported are arranged tend to oscillate in the longitudinal direction during operation. These longitudinal oscillations remain without any noticeable influence in chain delivery systems in which the sheets are held only at the leading edge during transport. In chain delivery systems in which the sheets are held at their leading and trailing edges, however, these oscillations can lead to damage to the sheet, for example creasing or tearing.

SUMMARY OF THE INVENTION

It is accordingly an object of the invention to provide a device for feeding sheets to a sheet stack which overcomes the above-mentioned disadvantages of the prior art devices of this general type, which reduces longitudinal oscillations.

With the foregoing and other objects in view there is provided, in accordance with the invention a device for transporting sheets. The device contains a chain gripper system having holding devices for holding sheets at leading and trailing edges thereof, a first clutch being a controllable clutch for setting a spacing between the holding devices, and at least one second clutch disposed at a distance from the first clutch in a sheet transport direction.

It is a particular advantage of the invention that, as a result of the use of a second clutch, longitudinal oscillations in the transport chains are reduced. A further advantage results from the use of a torque compensation mechanism, in particular in the region of the sprocket deflection shaft, since the greatest oscillations can occur here.

In accordance with an added feature of the invention, a sprocket drive shaft is provided and the first clutch is disposed on the sprocket drive shaft. A sprocket deflection shaft is further provided and the second clutch disposed on the sprocket deflection shaft. Ideally, the first clutch is a rotary clutch and the second clutch is a diaphragm spring clutch.

In accordance with another feature of the invention, the sprocket drive shaft has an inner shaft and an outer shaft enclosing the inner shaft coaxially. The sprocket deflection shaft also has an inner shaft and an outer shaft enclosing the inner shaft coaxially.

In accordance with an additional feature of the invention, the inner and outer shafts are rotationally fixedly connected to sprockets and are disposed such that the inner and outer shafts can be rotated relative to one another.

In accordance with a further feature of the invention each of the inner and outer shafts is assigned a rotary encoder for registering a rotational angle position of the sprockets.

In accordance with a concomitant feature of the invention, a torque compensation mechanism is assigned to the sprocket deflection shaft.

Other features which are considered as characteristic for the invention are set forth in the appended claims.

Although the invention is illustrated and described herein as embodied in a device for feeding sheets to a sheet stack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
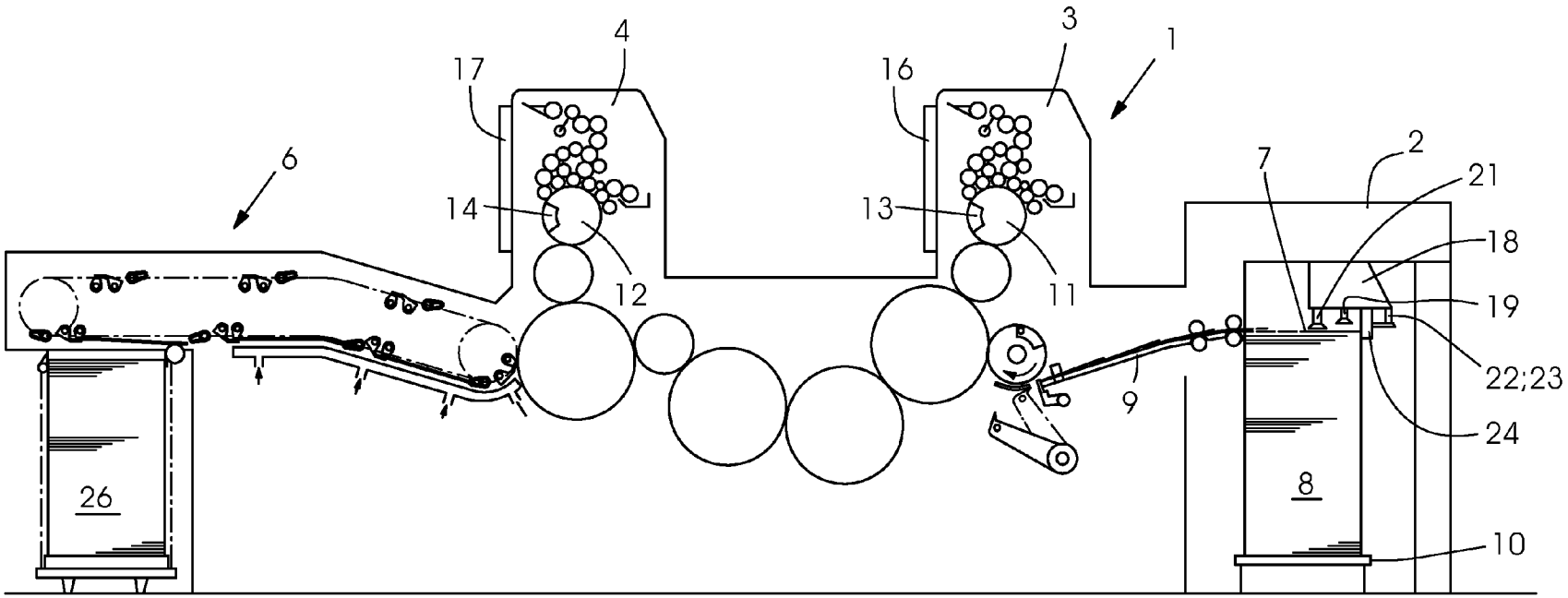
FIG. 1 is a diagrammatic, longitudinal sectional view of a sheetfed rotary printing press according to the invention.
Figure 2:
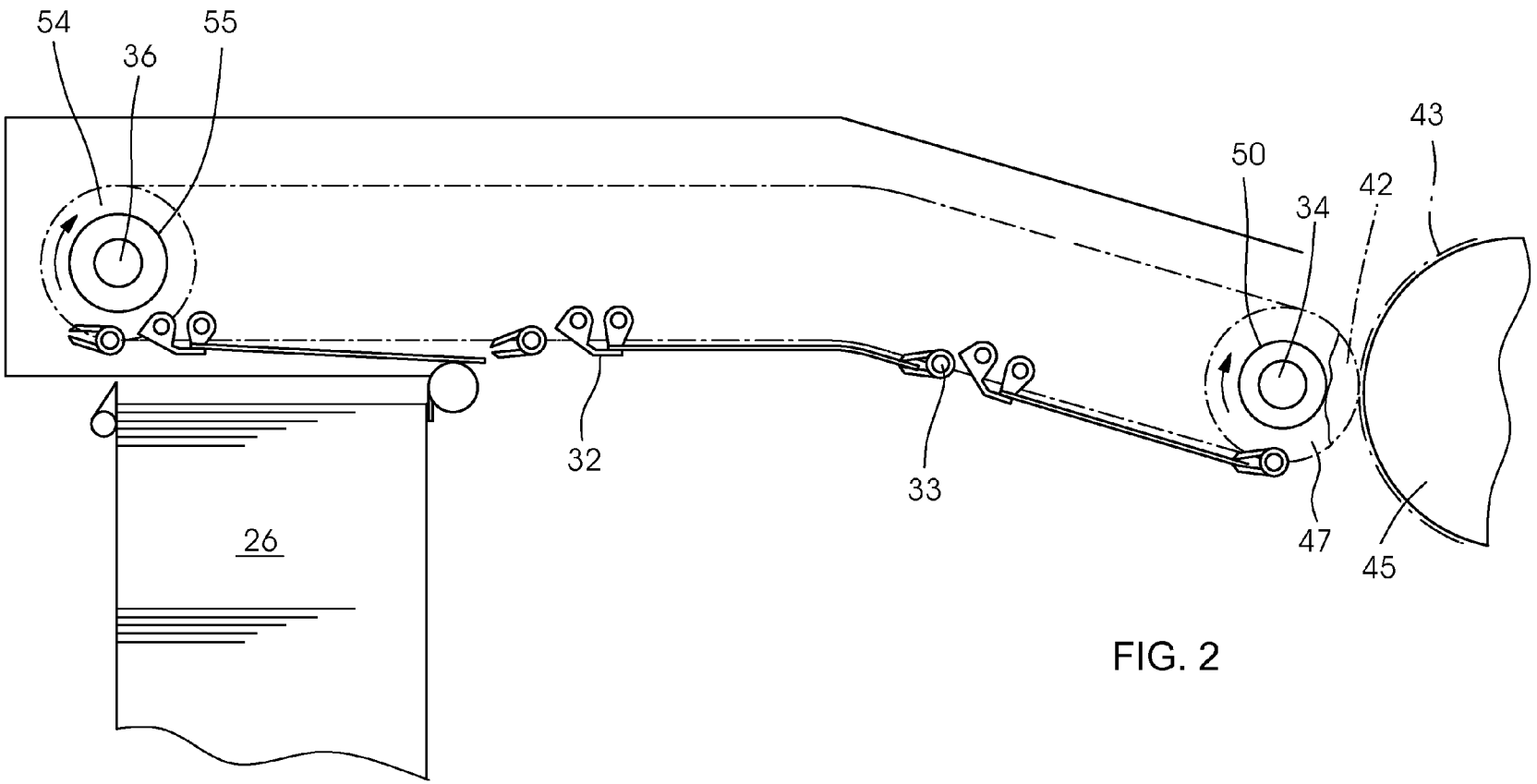
FIG. 2 is a diagrammatic, side view of a chain gripper system in a delivery of a sheet-processing machine.

Referring now to the figures of the drawing in detail and first, particularly, to FIG. 1 thereof, there is shown a machine for processing sheets 7, for example a printing press 1, that has a feeder 2, at least one printing unit 3 and 4, respectively, and a delivery 6. The sheets 7 are removed from a sheet stack 8 and, separated or overlapping, are fed over a feed table 9 to the printing units 3 and 4. The latter respectively contain, in a known way, a plate cylinder 11, 12. The plate cylinders 11 and 12 each have a device 13, 14 for fixing flexible printing plates. Furthermore, each plate cylinder 11, 12 is assigned a device 16, 17 for semiautomatic or fully automatic printing plate changing.

The sheet stack 8 rests on a stack board 10 that can be raised under control. The sheets 7 are removed from the top side of the sheet stack 8 by what is known as a suction head 18 which, inter alia, has a number of lifting and dragging suckers 19, 21 for separating the sheets 7. Furthermore, blowing devices 22 for loosening the upper layers of sheets are provided, as are sensing elements 23 for stack tracking. In order to align the sheet stack 8, in particular the upper sheets 7 of the sheet stack 8, a number of lateral and rear stops 24 are provided.

Figure 3:
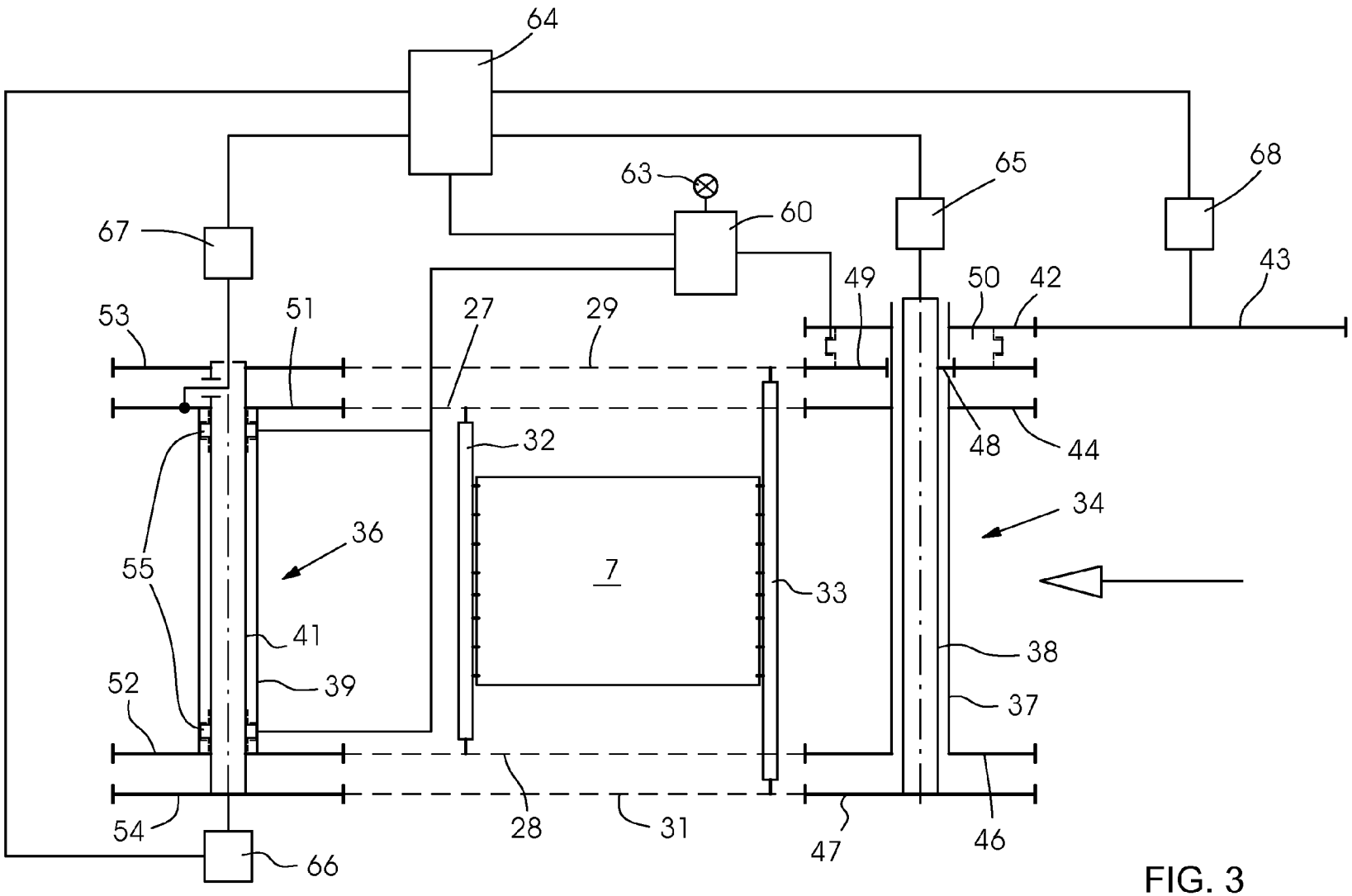
FIG. 3 is a diagrammatic, plan view of the chain gripper system.

The delivery 6 has a chain gripper system for delivering the sheets 7 onto a delivery stack 26. The chain gripper system has respectively two chains 27, 28; 29, 31 for transporting gripper bars 32 for holding a sheet leading edge and gripper bars 33 for holding a sheet trailing edge (see FIG. 3). The gripper bars 32, 33 are arranged at a distance from one another in the sheet transport direction and can be set to the format length to be processed. The endless chains 27, 28; 29, 31 are driven by a sprocket drive shaft 34 and deflected over a sprocket deflection shaft 36. The sprocket shafts 34, 36 each have two shafts 37, 38; 39, 41 mounted coaxially in each other. Seated on the outer shaft 37 of the sprocket drive shaft 34, rotationally fixedly connected to the outer shaft 37, is a drive gear 42, which meshes with a last gear 43, for example a gear of an impression cylinder 45 of the sheet-processing machine 1.

Furthermore, a sprocket 44 for the chain 27 and a sprocket 46 for the chain 28 are rotationally fixedly seated on the outer shaft 37 of the sprocket drive shaft 34. The inner shaft 38, mounted coaxially in the outer shaft 37, carries a sprocket 47 rotationally fixedly connected thereto for the chain 31 and, by a driver 48, has a rotary connection to a sprocket 49 rotatably mounted on the outer shaft 37. The driver 48 reaches through an opening in the outer shaft 37, in order to be able to rotate the sprocket 49 with respect to the outer shaft 37.

A controllable rotary clutch 50 is arranged between the drive gear 42 and the sprocket 49, in order to be able to couple all the sprockets 44, 49; 46, 47 to one another for format adjustment.

Seated on the outer shaft 39 of the sprocket deflection shaft 36 and rotationally fixedly connected thereto are a sprocket 51 for the chain 27 and a sprocket 52 for the chain 28.

Seated on the inner shaft 41 of the sprocket deflection shaft 36 and rotationally fixedly connected thereto are a sprocket 53 for the chain 29 and a sprocket 54 for the chain 31.

A controllable clutch 55 is provided between the inner shaft 41 and the outer shaft 39 of the sprocket deflection shaft 36, in order to couple all the sprockets 51 to 54 to one another.

Figure 4:
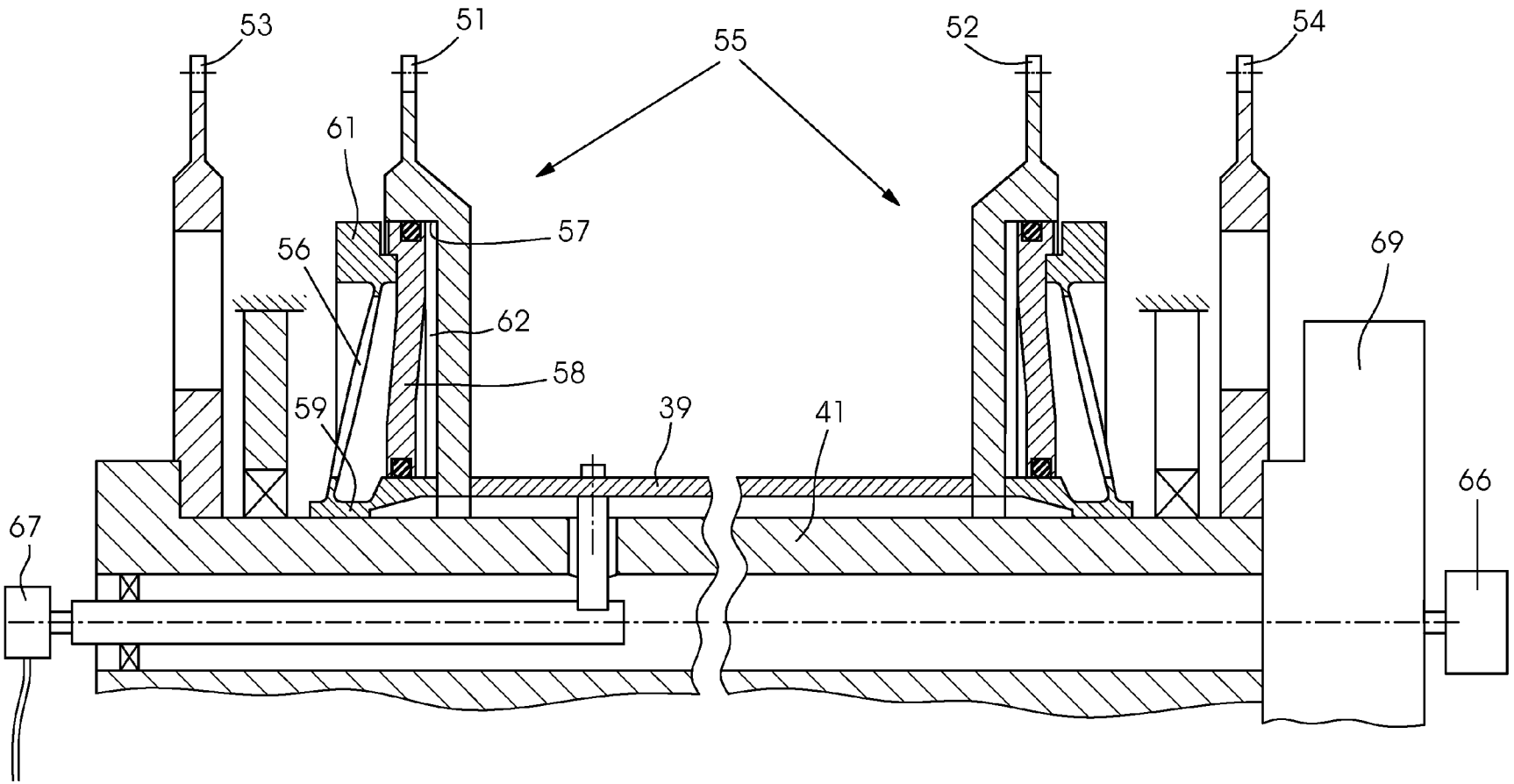
FIG. 4 is a diagrammatic, sectional view through a sprocket deflection shaft from a rear view.

The clutch 55 substantially contains two diaphragm spring clutches 56, which enclose the inner shaft 41 coaxially and are in each case arranged at the end of the outer shaft 39 (see FIG. 4). These are arranged mirror-symmetrically but are otherwise identical. These will therefore be described by using a single diaphragm spring clutch 56. The sprocket 51; 52 in each case has a cylindrical cavity 57, in which a piston 58 is arranged such that it can be moved axially. The diaphragm spring 56 has an inner ring 59 which is connected to the outer shaft 39 and which is connected to an outer ring 61 via spring elements 56, for example struts or spokes, extending radially. A working space 62 formed by the piston 58 and the cylinder 57 can be loaded by a working medium, for example oil or air. By activating the piston 58, the outer ring 61 is displaced axially and, via the inclined spring elements 56 and the inner ring 59, applies a radially directed force to the inner shaft 41. This force is sufficient to produce a press fit from a sliding fit of the inner ring 59 on the inner shaft 41. As a result of this measure, the sprockets 51, 52 are controllably connected to the inner shaft 41 and, respectively, the sprockets 53, 54.

The clutches 50, 55 are connected by a control valve arrangement 60 to a pressure generator 63. The control valve arrangement 60 is controlled by a control computer 64. Each sprocket shaft 34, 36 is in each case assigned a rotary encoder 65 for the inner shaft 38 of the sprocket drive shaft 34, a rotary encoder 68 indirectly for the outer shaft 37 of the sprocket drive shaft 34, a rotary encoder 66 for the inner shaft 41 of the sprocket deflection shaft 36, and a rotary encoder 67 for the outer shaft 39 of the sprocket deflection shaft 36, in order to register the rotational position. The rotary encoders 65, 68, 66, 67 are likewise connected to the control computer 64; this is preferably also the control computer of the sheet-processing machine 1.

In order to compensate for torques arising in the delivery 6, the sprocket deflection shaft 36 has a torque compensation mechanism 69. According to FIG. 4, this is connected to the inner shaft 41 of the sprocket deflection shaft 36.

For the purpose of format setting, that is to say to set the distance between the gripper bars 32 for holding the sheet leading edge and the gripper bars 33 for holding the sheet trailing edge, both clutches 50, 55 are disengaged. While the drive gears 42, 43 are at a standstill here, the inner shaft 38 is rotated by an auxiliary motor, not illustrated, and therefore so are the sprockets 47, 49 for the chains 29, 31 which hold the gripper bars 33 for the sheet trailing edge. As a result of this measure, the format spacing between the gripper bars 32, 33 changes. Once the desired format spacing has been set, the clutch 50 is engaged. The second clutch 55 is subsequently engaged with the chains 27, 28, 29, 31 slack.

The invention claimed is:

1. A device for transporting sheets, the device comprising:
- a chain gripper system having holding devices for holding sheets at leading and trailing edges thereof;
- a first clutch being a controllable clutch for setting a spacing between said holding devices;
- at least one second clutch disposed at a distance from said first clutch in a sheet transport direction;
- a sprocket drive shaft, said first clutch disposed on said sprocket drive shaft, said sprocket drive shaft having an inner shaft and an outer shaft enclosing said inner shaft coaxially;
- a sprocket deflection shaft, said second clutch disposed on said sprocket deflection shaft, said sprocket deflection shaft having an inner shaft and an outer shaft enclosing said inner shaft coaxially; and
- drive sprockets disposed on said sprocket drive shaft, said drive sprockets engaging chains of said chain gripper systems on which said holding devices are disposed.

2. The device according to claim 1, further comprising a torque compensation mechanism assigned to said sprocket deflection shaft.

3. The device according to claim 1, wherein said first clutch is a rotary clutch and said second clutch is a diaphragm spring clutch.

4. The device according to claim 1, further comprising sprockets, said inner and outer shafts are rotationally fixedly connected to said sprockets and are disposed such that said inner and outer shafts can be rotated relative to one another.

5. The device according to claim 4, further comprising rotary encoders, each of said inner and outer shafts is assigned one of said rotary encoders for registering a rotational angle position of said sprockets.

6. The device according to claim 1, further comprising sprockets, said inner and outer shafts are rotationally fixedly connected to said sprockets and are disposed such that said inner and outer shafts can be rotated relative to one another.

7. The device according to claim 6, further comprising rotary encoders, each of said inner and outer shafts is assigned one of said rotary encoders for registering a rotational angle position of said sprockets.

8. A sheetfed rotary printing press, comprising:
- a device for transporting sheets, the device containing:
- a chain gripper system having holding devices for holding sheets at leading and trailing edges thereof;
- a first clutch being a controllable clutch for setting a spacing between said holding devices;

at least one second clutch disposed at a distance from said first clutch in a sheet transport direction;

a sprocket drive shaft having an inner shaft and an outer shaft enclosing said inner shaft coaxially, said first clutch disposed on said sprocket drive shaft;

a sprocket deflection shaft having an inner shaft and an outer shaft enclosing said inner shaft coaxially, said second clutch disposed on said sprocket deflection shaft; and drive sprockets disposed on said sprocket drive shaft, said drive sprockets engaging chains of said chain gripper systems on which said holding devices are disposed.

9. The device according to claim 8, further comprising deflection sprockets disposed on said sprocket deflection shaft, said deflection sprockets engaging said chains.

10. A device for transporting sheets, the device comprising:

a chain gripper system having chains and holding devices for holding sheets at leading and trailing edges thereof, said holding devices being disposed on said chains;

a first clutch being a controllable clutch for setting a spacing between said holding devices;

at least one second clutch disposed at a distance from said first clutch in a sheet transport direction;

a sprocket drive shaft having an inner shaft and an outer shaft enclosing said inner shaft coaxially, said first clutch disposed on said sprocket drive shaft;

a sprocket deflection shaft having an inner shaft and an outer shaft enclosing said inner shaft coaxially, said second clutch disposed on said sprocket deflection shaft and coupling said inner shaft of said sprocket deflection shaft to said outer shaft of said sprocket deflection shaft; and drive sprockets disposed on said sprocket drive shaft, said drive sprockets engaging said chains.

11. The device according to claim 10, further comprising deflection sprockets disposed on said sprocket deflection shaft, said deflection sprockets engaging said chains.

* * * * *